United States Patent [19]

Nakayama et al.

[11] Patent Number: 4,584,254

[45] Date of Patent: Apr. 22, 1986

[54] SILICONE RESIN COATED CARRIER PARTICLES FOR USE IN A TWO-COMPONENT DRY-TYPE DEVELOPER

[75] Inventors: Nobuhiro Nakayama; Tetsuo Isoda, both of Numazu; Yoichiro Watanabe, Fuji; Mitsuo Aoki, Numazu, all of Japan

[73] Assignee: Ricoh Company, Ltd., Tokyo, Japan

[21] Appl. No.: 716,143

[22] Filed: Mar. 26, 1985

[30] Foreign Application Priority Data

Mar. 27, 1984 [JP] Japan ..... 59-57323

[51] Int. Cl.[4] ..... G03G 9/10

[52] U.S. Cl. ..... 430/108; 428/405

[58] Field of Search ..... 430/108; 428/405

[56] References Cited

U.S. PATENT DOCUMENTS

| | | | |
|---|---|---|---|
| 3,833,366 | 9/1974 | Madrid et al. | 428/405 X |
| 3,840,464 | 10/1974 | Van Engeland et al. | 430/108 |
| 4,191,587 | 3/1980 | Kratel et al. | 428/405 X |

FOREIGN PATENT DOCUMENTS

| | | | |
|---|---|---|---|
| 54-21730 | 2/1979 | Japan | 430/108 |
| 57-191650 | 11/1982 | Japan | 430/108 |
| 58-174958 | 10/1983 | Japan | 430/108 |
| 2119108 | 11/1983 | United Kingdom | 430/108 |

*Primary Examiner*—Roland E. Martin

*Attorney, Agent, or Firm*—Oblon, Fisher, Spivak, McClelland & Maier

[57] ABSTRACT

Carrier particles for use in a two-component dry-type developer for developing latent electrostatic images are disclosed, which core particle comprises a core particle and a silicone resin layer coated on the core particles, and the silicone resin layer contains an organic tin compound, which serves as a catalyst for hardening the silicone resin layer in the course of the formation of the silicone resin layer on the core particle under application of heat thereto, with a concentration gradient in the direction of the thickness of the silicone resin layer towards the outer surface of the carrier particles.

7 Claims, 2 Drawing Figures

SILICONE RESIN COATED CARRIER PARTICLES FOR USE IN A TWO-COMPONENT DRY-TYPE DEVELOPER

BACKGROUND OF THE INVENTION

The present invention relates to carrier particles of a two-component dry-type developer for developing latent electrostatic images to visible images for use in electrophotography, electrostatic recording methods and electrostatic printing methods. More particularly, it relates to carrier particles coated with a silicone resin layer containing an organic tin compound serving as a catalyst for hardening the silicone resin layer in the course of the formation of the silicone resin layer on a core material, with the concentration of the organic tin compound being changed in the direction of the thickness of the layer towards the outer surface of the carrier particles.

Conventionally, a variety of two-component dry-type developers are known, which comprise carrier particles and toner particles. In such two-component dry-type developers, toner particles which are usually much smaller than the carrier particles are triboelectrically attracted to the carrier particles and are held on the surface of the carrier particles. The electric attraction between the toner particles and the carrier particles is caused by the friction between the toner particles and the carrier particles. When the toner particles held on the carrier particles are brought near or into contact with a latent electrostatic image, the electric field of the latent electrostatic image works on the toner particles to separate the toner particles from the carrier particles, overcoming the bonding force between the toner particles and the carrier particles. As a result, the toner particles are attracted towards the latent electrostatic image, so that the latent electrostatic image is developed to a visible toner image. In the two-component dry-type developers, only the toner particles are consumed as development is performed. Therefore, it is necessary to replenish the toner particles from time to time in the course of the development of latent electrostatic images.

Further, it is necessary that the carrier particles be capable of triboelectrically charging toner particles to the desired polarity and with a sufficient amount of charges, and that the amount of the electric charges and the polarity thereof be maintained for a long period of time for use. In a conventional two-component type developer, it is apt to occur that the surface of the carrier particles is eventually covered with a resin released from the toner particles in the course of the mechanical mixing of the toner particles with the carrier particles in the development apparatus. Once the phenomenon of the surface of the carrier particles being covered with such resin takes place, which is generally referred to as the "spent phenomenon", such carrier particles no longer function as active carrier particles, that is, carrier particles which contribute to development. As a result, the charging characteristics of the carrier particles in the conventional two-component type developer deteriorate with time while in use. In the end, it is necessary to replace the entire developer by a new developer.

In order to prevent the spent phenomenon, a method of coating the surface of carrier particles with a variety of resins has been proposed. However, resins which can in fact prevent the spent phenomenon have not been discovered. At one extreme, for instance, carrier particles coated with a styrene methacrylate copolymer or polystyrene are excellent in the triboelectric charging properties. However, since the surface energy of the carrier particles is comparatively high, the carrier particles are easily covered with the resin released from the toner particles while in use. In other words, the spent phenomenon occurs easily and, accordingly, the life of such developer is short.

The above-mentioned "spent phenomenon" scarcely takes place in the carriers coated with polytetrafluoroethylene polymers, since such carriers have a low surface energy. However, since the polytetrafluoroethylene polymers are positioned on the extreme negative side in the triboelectric series, the carriers coated with the polytetrafluoroethylene polymers cannot be employed for charging toners to a negative polarity.

As carrier particles coated with a coating layer having a low surface energy, for example, the following carrier particles have been proposed, which are coated with a layer containing a silicone resin having a low surface energy:

- Carrier particles coated with a coating layer in which an unsaturated silicone resin, an organosilicon, silanol and other resins are mixed with a styrene-acrylic resin, as disclosed in U.S. Pat. No. 3,562,533;
- Carrier particles coated with a coating layer comprising a polyphenylene resin and an organosilicon-containing terpolymer resin, as disclosed in U.S. Pat. No. 3,847,127;
- Carrier particles coated with a coating layer comprising a styrene-acrylate-methacrylate resin, organosilane, silanol, siloxane and other resins, as disclosed in U.S. Pat. No. 3,627,522;
- Carrier particles coated with a coating layer comprising a silicone resin and a nitrogen-containing resin having positive charging characteristics, as disclosed in Japanese Laid-Open Patent Application No. 55-127567; and
- Carrier particles coated with a coating layer comprising a modified silicone resin, as disclosed in Japanese Laid-Open Patent Application No. 55-157751.

The Q/M (the quantity of electric charges per unit weight of developer) of some dry-type developers for developing latent electrostatic images comprising silicone resin coated carriers and toner particles increases while in use, and the Q/M of other dry-type developers decreases as the thickness of the silicone resin coated layer of the carrier particles decreases while in use, with the result that the charging capability of the carrier particles changes while in use. Such changes in the Q/M also depend upon the kinds of employed toners and the polarity to which the toner particles are charged. However, the reasons why the Q/M of some developers decreases and the Q/M of other developers increases while in use are unknown. In any event, if the Q/M of the developer changes while in use, the developing performance changes and therefore good toner images cannot be obtained in a stable manner.

SUMMARY OF THE INVENTION

It is therefore an object of the present invention to provide carrier particles for use in a two-component dry-type developer for developing latent electrostatic images to visible toner images, which carrier particles are capable of retaining high charging performance and are not eventually subjected to the spent phenomenon while in use. Thus the developers using the carrier particles according to the present invention are capable of yielding high quality developed images without deterioration for an extended period of time.

The above object of the present invention is attained by the carrier particles coated with a silicone resin layer containing an organic tin compound which serves as a catalyst for hardening the silicone resin layer in the course of the formation of the silicone resin layer on a core material of the carrier particles, with the concentration of the organic tin compound being changed in the direction of the thickness of the layer towards the surface of the carrier particles.

In the case where the charging performance of the carrier particles decreases due to the decrease of the thickness of the silicone resin layer, so that the Q/M of the developer decreases while in use, the carrier particles are constructed in such a manner that the concentration of the organic tin compound in the silicone resin layer increases toward the inside of the carrier particle, whereby a developer whose Q/M does not decrease while in use can be obtained.

In the case where the Q/M of the developer increases in spite of the decrease of the thickness of the silicone resin layer while in use, the carrier particles are constructed in such a manner that the concentration of the organic tin compound in the silicone resin layer increases toward the outside of the carrier particle, whereby a developer whose Q/M does not change while in use can be obtained.

DETAILED DESCRIPTION OF THE PREFERRED EMBODIMENTS

Figure 1:
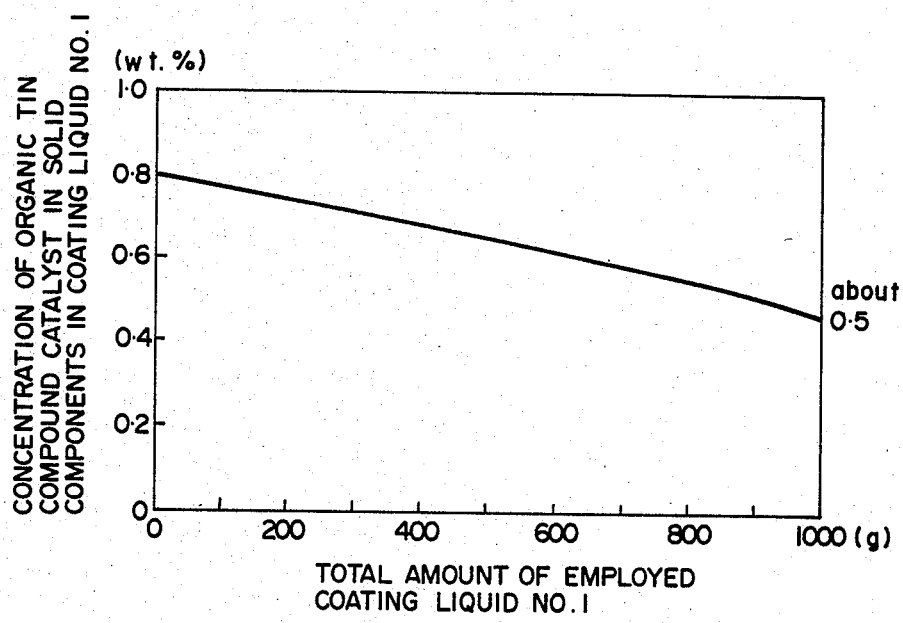
FIG. 1 is a diagram of the concentration gradient of an organic tin compound (dibutyl tin diacetate) in the silicone resin layer of an embodiment of the carrier particles according to the present invention.

The silicone resin for use in the silicone resin layer of the carrier particles according to the present invention is represented by the following general formula (I):

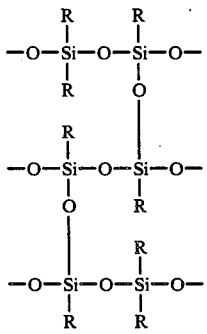

where R represents hydrogen, halogen, hydroxy, methoxy, lower alkyl having 1 to 4 carbon atoms, or phenyl.

Specific examples of the organic tin compounds for use in the present inventions are as follows:

1. $R^1Sn(OCOR^2)_2$
   wherein $R^1$ and $R^2$ each represent an alkyl group of $C_1 \sim C_{12}$.
   (Specific Example): $(H_3C(CH_2)_3)_2Sn(OCOCH_3)_2$
2. $Sn(OCOCH_3)_2$
3. 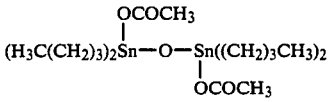
4. 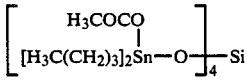
5. $(CH_3(CH_2)_3)_2Sn(OCH_3)_2$
6. 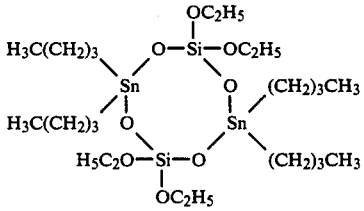

In the present invention, the carrier particle comprises a core particle and a silicone resin layer coated on the core particle, and the organic tin compound is contained in the silicone resin layer in such a manner that the concentration of the organic tin compound is changed in the direction of the thickness of the layer towards the surface of the carrier particle, whereby the carrier particles can electrically charge toner particles to the desired polarity and the Q/M of the developer can be maintained substantially constant for an extended period of time.

As the material for the core particles, for example, magnetic metals such as iron, nickel, cobalt and ferrite, non-magnetic metals such as copper and bronze, and non-metallic materials such as Carborundum, glass beads and silicone dioxide can be employed.

It is preferable that the particle size of the core particles be in the range of from 30 μm to 700 μm, more preferably in the range of from 50 μm to 200 μm.

For preparation of silicone resin coated carrier particles according to the present invention, the above-mentioned silicone resin and an organic tin compound are dissolved in an appropriate organic solvent to prepare a coating liquid, followed by coating the core particles with the coating liquid by immersing the core particles in the coating liquid, by spraying the coating liquid on the core particles or by a fluidized bed process which will be explained later.

After the core particles are coated with the coating liquid as mentioned above, the core particles are dried and heated, so that the coated silicone resin layer is hardened on the core particles, thus the carrier particles according to the present invention are prepared.

The organic tin compound contained in the coating liquid serves as a catalyst for hardening the silicone resin layer under application of heat thereto. It is preferable that the organic tin compound be contained in the silicone resin layer in an amount ranging from 0.1 wt. % to 5 wt. % of the solid components of the silicone resin layer.

As the organic solvent for dissolving the silicone resin and the organic tin compound therein, any solvents can be employed so long as the silicone resin and the organic tin compound can be dissolved therein. Specific examples of such solvents are alcohols such as methanol, ethanol and isopropanol, aromatic hydrocarbons such as toluene and xylene, ketones such as acetone and methyl ethyl ketone, and tetrahydrofuran and dioxane, and mixtures of the above.

It is preferable that the thickness of the coated silicone resin layer be in the range of from 0.1 μm to 10 μm, more preferably in the range of from 0.4 μm to 5 μm.

As mentioned previously, in the present invention, the concentration of the organic tin compound is changed in the direction of the thickness of the silicone resin layer, either the concentration being increased or decreased toward the surface of the carrier particle. It is preferable that the concentration gradient of the organic tin compound in the direction of the thickness of the silicone resin layer be in the range of from 0.02 wt. %/μm to 1.0 wt. %/μm, more preferably in the range of from 0.05 wt. %/μm to 0.5 wt. %/μm.

The silicone resin coated carriers according to the present invention can be prepared as follows by the above-mentioned fluidized bed process:

Core particles are elevated to a balanced height by a stream of a pressure-applied gas (usually a stream of pressure-applied air) which flows upwards within a fluidized bed apparatus. While the elevated core particles are suspending in the upward air stream, the coating liquid is sprayed on the core particles of the carrier particles. The above step is repeated until the core particles are coated with a silicone resin layer having the desired thickness.

As the toner for use with the above prepared carrier particles, a toner which essentially consists of a resin and a pigment or dye can be employed.

As the pigment or dye, the following dyes, pigments and mixtures thereof can be employed: carbon black, a metal complex salt monoazo-type dye such as Spilon Black BH (commercially available from Hodogaya Chemical Co., Ltd.), Nigrosine dye (C.I. No. 504158), Aniline Blue (C.I. No. 50405), Calconyl Blue (C.I. No. Azess Blue 3), Chrome Yellow (C.I. No. 14090), Ultramarine Blue (C.I. No. 77103), Methylene Blue Choride (C.I. No. 52015), Phthalocyanine Blue (C.I. No. 74160), Du Pont Oil Red (C.I. No. 26105), Quinoline Yellow (C.I. No. 47005), Malachilte Green Oxalate (C.I. No. 42000), Lamp Black (C.I. No. 77266), Rose Bengale (C.I. No. 45435) and Zabon First Black New (C.I. No. 12195 Solvent Dye).

As the resin for the toner, styrene resins such as homopolymers of styrene and copolymers of styrene and other vinyl monomers are mainly employed. As the other vinyl monomers, ethylenic unsaturated mono-olefines such as ethylene, propylene and isobutylene; halogenated vinyl monomers such as vinyl chloride, vinyl bromide and vinyl fluoride; vinyl esters such as vinyl acetate; acrylic acid esters such as methyl acrylate, ethyl acrylate and phenyl acrylate; vinyl ethers such as vinyl methyl ether and vinyl ethyl ether; vinyl ketones such as vinyl methyl ketone and vinyl hexyl ketone; N-vinyl compounds such as N-vinylpyrrole and N-vinylpyrrolidone; acrylonitrile; methacrylonitrile; acrylamide; methacrylamide; and mixtures of the above compounds.

In addition to the above styrene resins, polyethylene, polypropylene, polyvinyl ester, rosin-modified phenolic resin, epoxy resin, acrylic resin and polyester resin can be employed as the resins for the toner.

Embodiments of the present invention will now be explained by referring to the following examples, in which the term "part(s)" means part(s) by weight.

EXAMPLE 1

[Preparation of 10% Silicone Varnish]

In a round-bottom flask with a stirrer were placed 12 parts of toluene, 14 parts of butanol, 14 parts of water and 34 parts of ice. To the resulting mixture, there were added very slowly, with stirring, 26 parts of a silane mixture consisting of $CH_3SiCl_3$ and $(CH_3)_2SiCl_2$ with the respective molar ratio of 10:1. The mixture was stirred for 30 minutes. The resulting mixture became separated into two layers, a lower aqueous layer and an upper organic liquid layer which was referred to as the siloxane layer. The siloxane layer was separated from the aqueous layer. To this siloxane layer were added 26 parts of concentrated hydrochloric acid. Thereafter, the mixture was heated with stirring at 50° C. to 60° C., thus a condensation reaction was caused to take place. About one hour later, a hydrochloric acid layer was removed. The resulting siloxane was washed with water two times. The thus washed siloxane was dissolved in a mixed solvent consisting of toluene, butanol and ligroin, whereby a 10% silicone varnish containing 10 wt. % of the solid components of the silicone resin was prepared.

[Preparation of Coating Liquid A]

To the thus prepared 10% silicone varnish, dibutyl tin diacetate was added in an amount of 0.2 wt. % to the amount of the solid components contained in the 10% silicone varnish. This mixture was then diluted with toluene in a volume of 9 times the volume of the mixture, whereby a coating liquid A was prepared.

[Preparation of Coating Liquid B]

Likewise, to the 10% silicone varnish, dibutyl tin diacetate was added in an amount of 0.8 wt. % to the amount of the solid components contained in the 10% silicone varnish. This mixture was then diluted with toluene in a volume of 9 times the volume of the mixture, whereby a coating liquid B was prepared.

[Preparation of Carrier Particles No. 1]

As the coating liquid A was added at a rate of 10 g/min to 900 g of the coating liquid B, with stirring by a chemical stirrer, to prepare a coating liquid No. 1, the coating liquid No. 1 was applied to 5,000 g of spherical ferrite core particles having an average particle size of 100 μm in an atmosphere of 90° C. in a circulation-type fluidized bed apparatus, until the total amount of the coating liquid No. 1 amounted to 1000 g, so that the ferrite core particles were coated with the coating liquid No. 1. Thereafter, the silicone resin coated ferrite core particles were heated at 250° C. for 30 minutes for promoting the hardening reaction of the coated silicone resin layer, whereby silicone resin coated carrier particles No. 1 according to the present invention were prepared.

FIG. 1 shows the concentration gradient of the organic tin compound catalyst (dibutyl tin diacetate) in the direction of the thickness of the silicone resin layer towards the surface of the carrier particle.

[Preparation of Toner No. 1]

A toner No. 1 for use with the above prepared carrier particles No. 1 was prepared as follows:

A mixture of the following components was kneaded under application of heat at a temperature of 160° C. by a roll mill:

| | Parts by Weight |
|---|---|
| Styrene - n-butylmethacrylate copolymer | 100 |
| Carbon black | 10 |
| Metal complex type monoazo dye (commercially available under the name of Spilon Black BH from Hodogaya Chemical Co., Ltd.) | 2 |

After cooling the kneaded mixture, it was roughly crushed by a speed mill. Thereafter the mixture was finely divided by a jet mill and was then subjected to classification by a pneumatic classifier, whereby a toner No. 1 having an average particle size of 6 μm was prepared.

[Preparation of Two-Component Dry-Type Developer No. 1]

100 parts of the carrier particles No. 1 and 2.5 parts of the above prepared toner No. 1 were mixed, whereby a two-component dry-type developer No. 1 was prepared. The toner No. 1 was negatively charged by the carrier particles No. 1.

[Image Formation Tests]

Image formation tests were carried out by a commercially available copying machine (FT-6400 made by Ricoh Co., Ltd.) which was slightly modified for the convenience of the tests, with incorporation of a selenium photoconductor, using the two-component dry-type developer No. 1.

In the tests, latent electrostatic images with a positive polarity were formed on the selenium photoconductor 30 times per minute and developed using the developer No. 1. The developed toner images were transferred to a transfer paper. Thus, image formation was repeated 100,000 times, with replenishment of the toner from time to time in the course of the tests.

The changes in the thickness of the silicone resin layer and the changes in the Q/M of the developer No. 1 in the course of the image formation tests are shown in Table 1.

COMPARATIVE EXAMPLE 1

[Preparation of Coarting Liquid C]

To the 10% silicone varnish prepared in Example 1, dibutyl tin diacetate was added in an amount of 0.5 wt. % to the amount of the solid components contained in the 10% silicone varnish. This mixture was then diluted with toluene in a volume of 9 times the volume of the mixture, whereby a coating liquid C was prepared.

[Preparation of Comparative Carrier Particles No. 1]

The coating liquid C was applied to 5,000 g of spherical ferrite core particles having an average particle size of 100 μm in an atmosphere of 90° C. in a circulation-type fluidized bed apparatus, until the total amount of the coating liquid C amounted to 1000 g, so that the ferrite core particles were coated with the coating liquid C. Thereafter, the silicone resin coated ferrite core particles were heated at 250° C. for 30 minutes for promoting the hardening reaction of the silicone resin layer, whereby comparative silicone resin coated carrier particles No. 1 were prepared.

In the silicone resin coated layer of the comparative carrier particles No. 1, the concentration of the dibutyl tin diacetate was uniform in the direction of the thickness of the silicone resin layer.

[Preparation of Comparative Two-Cpmponent Dry-Type Developer No. 1]

100 parts of the comparative carrier particles No. 1 and 2.5 parts of the toner No. 1 prepared in Example 1 were mixed, whereby a comparative two-component dry-type developer No. 1 was prepared. The toner No. 1 was negatively charged by the comparative carrier particles No. 1.

[Image Formation Tests]

Image formation tests were carried out in the same manner as in Example 1.

The changes in the thickness of the silicone resin coat layer and the changes in the Q/M of the comparative developer No. 1 in the course of the image formation tests are shown in Table 1.

TABLE 1

| Image Formation | | | 0 times | 20,000 times | 40,000 times | 60,000 times | 80,000 times | 100,000 times |
|---|---|---|---|---|---|---|---|---|
| Example 1 | Developer No. 1 | Thickness of Silicone Resin Layer (μm) | 1.02 | 0.93 | 0.85 | 0.79 | 0.72 | 0.67 |
| | | Q/M (μC/g) | −17.0 | −16.9 | −16.8 | −17.1 | −17.0 | −16.9 |
| Comparative Example 1 | Comparative Developer No. 1 | Thickness of Silicone Resin Layer (μm) | 1.07 | 0.98 | 0.91 | 0.83 | 0.74 | 0.65 |
| | | Q/M (μC/g) | −17.0 | −17.1 | −16.3 | −15.8 | −14.3 | −12.6 |

The above results indicate that the Q/M of the developer No. 1 using the carrier particles No. 1 according to the present invention scarcely changed in the course of the 100,000 times image formation tests. Accordingly the obtained image quality was very stable throughout the tests.

In contrast to this, the Q/M of the comparative developer No. 1 decreased in the course of the 100,000 times image formation tests. In accordance with the decrease of the Q/M, the image quality was significantly degraded as the image formation tests proceeded.

There was not much difference in the decrease in the thickness of the silicone resin layer between the developer No. 1 and the comparative developer No. 1.

EXAMPLE 2

[Preparation of Carrier Particles No. 2]

As the coating liquid B (prepared in Example 1) was added at a rate of 10 g/min to 900 g of the coating liquid A (prepared in Example 2), with stirring by a chemical stirrer, to prepare a coating liquid No. 2, the coating liquid No. 2 was applied to 5,000 g of spherical ferrite core particles having an average particle size of 100 μm in an atmosphere of 90° C. in a circulation-type fluidized bed apparatus, until the total amount of the coating liquid No. 2 amounted to 1,000 g, so that the ferrite core particles were coated with the coating liquid No. 2. Thereafter, the silicone resin coated ferrite core particles were heated at 250° C. for 30 minutes for promoting the hardening reaction of the silicone resin, whereby silicone resin coated carrier particles No. 2 according to the present invention were prepared.

Figure 2:
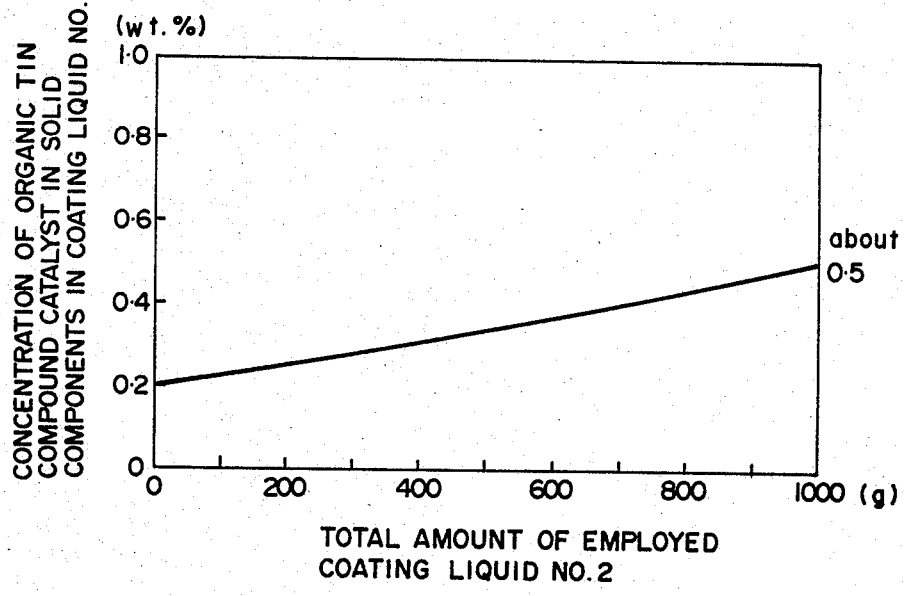
FIG. 2 is a diagram of the concentration gradient of the organic tin compound (dibutyl tin diacetate) in the silicone resin layer of another embodiment of the carrier particles according to the present invention.

FIG. 2 shows the concentration gradient of the organic tin compound catalyst (dibutyl tin diacetate) in the direction of the thickness of the silicone resin layer towards the surface of the carrier particle.

[Preparation of Toner No. 2]

A toner No. 2 for use with the above prepared carrier particles No. 2 was prepared as follows:

A mixture of the following components was kneaded under application of heat at a temperature of 160° C. by a roll mill:

| | Parts by Weight |
|---|---|
| Styrene - n-butylmethacrylate copolymer | 100 |
| Carbon black | 10 |
| Nigrosine type dye (commercially available under the name of Nigrosine Base Ex from Oriental Chemical Industrial Ltd.) | 2 |

After cooling the kneaded mixture, it was roughly crushed by a speed mill. Thereafter the mixture was finely divided by a jet mill and was then subjected to classification by a pneumatic classifier, whereby a toner No. 2 having an average particle size of 6 μm was prepared.

[Preparation of Two-Component Dry-Type Developer No. 2]

100 parts of the carrier particles No. 2 and 2.5 parts of the above prepared toner No. 2 were mixed, whereby a two-component dry-type developer No. 2 was prepared. The toner No. 2 was positively charged by the carrier particles No. 2.

[Image Formation Tests]

Image formation tests were carried out by a commercially available copying machine (FT-6400 made by Ricoh Co., Ltd.) which was slightly modified for the convenience of the tests, with incorporation of a two-layered organic photoconductor (comprising (i) a charge transfer layer comprising a hydrazone type charge transporting agent and polycarbonate and (ii) a charge generating layer comprising a bisazo pigment carrier generating agent and polyvinyl butyral), using the two-component dry-type developer No. 2. In the tests, latent electrostatic images having a negative polarity were formed on the organic photoconductor 30 times per minute and developed using the developer No. 2. The developed toner images were transferred to a transfer paper. Thus, image formation was repeated 100,000 times, with replenishment of the toner from time to time in the course of the tests.

The changes in the thickness of the silicone resin coat layer and the changes in the Q/M of the developer No. 2 in the course of the image formation tests are shown in Table 2.

COMPARATIVE EXAMPLE 2

[Preparation of Comparative Two-Component Dry-Type Developer No. 2]

100 parts of the comparative carrier particles No. 1 (prepared in Comparative Example 1) and 2.5 parts of the toner No. 2 (prepared in Example 2) were mixed, whereby a comparative two-component dry-type developer No. 2 was prepared. The toner No. 2 was positively charged by the comparative carrier particles No. 1.

[Image Formation Tests]

Image formation tests were carried out in the same manner as in Example 2.

The changes in the thickness of the silicone resin layer and the changes in the Q/M of the comparative developer No. 2 in the course of the image formation tests are shown in Table 2.

TABLE 2

| Image Formation | | | 0 times | 20,000 times | 40,000 times | 60,000 times | 80,000 times | 100,000 times |
|---|---|---|---|---|---|---|---|---|
| Example 1 | Developer No. 1 | Thickness of Si-Resin Layer (μm) | 1.03 | 0.96 | 0.85 | 0.79 | 0.70 | 0.60 |
| | | Q/M (μC/g) | +16.0 | +15.8 | +16.2 | +16.0 | +16.1 | +16.0 |
| Comparative Example 1 | Comparative Developer No. 1 | Thickness of Si-Resin Layer (μm) | 1.06 | 0.77 | 0.92 | 0.84 | 0.74 | 0.65 |
| | | Q/M (μC/g) | +16.0 | +17.0 | +16.9 | +17.8 | +18.5 | +19.7 |

The above results indicate that the Q/M of the developer No. 2 using the carrier particles No. 2 according to the present invention scarcely changed in the course of the 100,000 times image formation tests. Accordingly the obtained image quality was very stable throughout the tests.

In contrast to this, the Q/M of the comparative developer No. 2 increased in the course of the 100,000 times image formation tests. In accordance with the increased of the Q/M, the image quality was significantly varied during the above image formation tests.

As to the decrease in the thickness of the silicone resin layer, there was not much difference between the developer No. 2 and the comparative developer No. 2.

What is claimed is:

1. In carrier particles for use in a two-component dry-type developer for developing latent electrostatic images, the improvement wherein the core particle comprises a core particle and a silicone resin layer coated on said core particle, said silicone resin layer containing an organic tin compound, which serves as a catalyst for hardening said silicone resin layer in the course of the formation of said silicone resin layer on said core particle under application of heat thereto, with a concentration gradient in the direction of the thickness of said silicone resin layer towards the outer surface of said carrier particles.

2. Carrier particles as claimed in claim 1, wherein said organic tin compound is represented by the formula of $R^1Sn(OCOR^2)_2$ wherein $R^1$ and $R^2$ each represent an alkyl group having 1 to 12 carbon atoms.

3. Carrier particles as claimed in claim 1, wherein said organic tin compound is selected from the group consisting of:

$Sn(OCOCH_3)_2$,

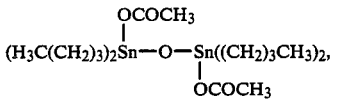

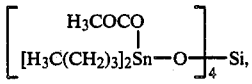

$(CH_3(CH_2)_3)_2Sn(OCH_3)_2$, and

-continued

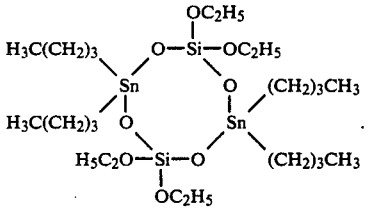

4. Carrier particles as claimed in claim 1, wherein the concentration gradient of said organic tin compound in the direction of the thickness of said silicone resin layer is in the range of from 0.01 wt. %/μm to 1.0 wt. %/μm.

5. Carrier particles as claimed in claim 1, wherein the amount of said organic tin compound in said silicone resin layer is in the range of from 0.1 wt. % to 5 wt. % of the solid components of said silicone resin layer.

6. Carrier particles as claimed in claim 1, wherein the particle size of said core particle is in the range of from 30 μm to 700 μm.

7. Carrier particles as claimed in claim 1, wherein the thickness of said silicone resin layer is in the range of from 0.1 μm to 10 μm.

* * * * *

UNITED STATES PATENT AND TRADEMARK OFFICE

CERTIFICATE OF CORRECTION

PATENT NO. : 4,584,254

DATED : April 22, 1986

INVENTOR(S) : Nakayama et al

It is certified that error appears in the above-identified patent and that said Letters Patent is hereby corrected as shown below:

Column 7, line 65 delete "Coarting" and insert therefor --Coating--.

Column 8, line 21 delete "Two-Cpmponent" and insert therefor --Two-Component--.

Column 10, line 56 delete "increased" and insert therefor --increase--.

Signed and Sealed this

*Twenty-third* Day of *September 1986*

[SEAL]

*Attest:*

DONALD J. QUIGG

*Attesting Officer*

*Commissioner of Patents and Trademarks*